US011454158B2

(12) United States Patent
Saruwatari

(10) Patent No.: US 11,454,158 B2
(45) Date of Patent: Sep. 27, 2022

(54) OUTBOARD MOTOR AND MARINE VESSEL

(71) Applicant: YAMAHA HATSUDOKI KABUSHIKI KAISHA, Iwata (JP)

(72) Inventor: Kimitaka Saruwatari, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 200 days.

(21) Appl. No.: 16/874,736

(22) Filed: May 15, 2020

(65) Prior Publication Data

US 2020/0370463 A1 Nov. 26, 2020

(30) Foreign Application Priority Data

May 20, 2019 (JP) ..... JP2019-094500

(51) Int. Cl.

| | |
|---|---|
| ***F01P 3/20*** | (2006.01) |
| ***B63H 20/28*** | (2006.01) |
| ***F01P 5/12*** | (2006.01) |
| *F01P 5/10* | (2006.01) |

(52) U.S. Cl.

CPC ..... *F01P 3/202* (2013.01); *B63H 20/28* (2013.01); *F01P 3/207* (2013.01); *F01P 5/12* (2013.01); *F01P 2005/105* (2013.01)

(58) Field of Classification Search

CPC .... F01P 3/202; F01P 3/207; F01P 5/12; F01P 2005/105; B63H 20/28

See application file for complete search history.

(56) References Cited

U.S. PATENT DOCUMENTS

| | | | | |
|---|---|---|---|---|
| 5,921,829 | A | 7/1999 | Iwata | |
| 6,748,906 | B1 | 6/2004 | White et al. | |
| 7,421,983 | B1 * | 9/2008 | Taylor | F01P 9/00 123/41.01 |
| 10,549,833 | B2 * | 2/2020 | Davis | B63H 20/02 |
| 2012/0028515 | A1 * | 2/2012 | Stasolla | B63H 23/10 440/3 |
| 2017/0241323 | A1 * | 8/2017 | Yin | F01P 3/207 |

FOREIGN PATENT DOCUMENTS

| | | | |
|---|---|---|---|
| JP | 09-309497 | A | 12/1997 |
| WO | 2014/127035 | A1 | 8/2014 |

* cited by examiner

*Primary Examiner* — Syed O Hasan

(74) *Attorney, Agent, or Firm* — Keating and Bennett, LLP

(57) ABSTRACT

An outboard motor includes an engine, a first cooling water passage to cool a first cooling target including the engine and through which first cooling water including water from outside an outboard motor body passes, a first pump to pump the first cooling water from outside the outboard motor body to the first cooling water passage, a second cooling water passage to cool a second cooling target different from the first cooling target and through which second cooling water different from the first cooling water passes, and a second pump to pump the second cooling water to the second cooling water passage.

20 Claims, 3 Drawing Sheets

FIRST (SECOND) EMBODIMENT

FIRST EMBODIMENT

FIRST EMBODIMENT

FIRST EMBODIMENT

SECOND EMBODIMENT

OUTBOARD MOTOR AND MARINE VESSEL

CROSS REFERENCE TO RELATED APPLICATIONS

This application claims the benefit of priority to Japanese Patent Application No. 2019-094500 filed on May 20, 2019. The entire contents of this application are hereby incorporated herein by reference.

BACKGROUND OF THE INVENTION

1. Field of the Invention

The present invention relates to an outboard motor and a marine vessel.

2. Description of the Related Art

An outboard motor that cools an engine with seawater is known in general. Such an outboard motor is disclosed in Japanese Patent Laid-Open No. 9-309497, for example.

Japanese Patent Laid-Open No. 9-309497 discloses an outboard motor that cools an engine with both seawater and cooling water. The outboard motor includes a seawater passage through which seawater passes, a seawater pump that pumps seawater from the outside to the seawater passage, a cooling water passage through which cooling water different from the seawater is circulated, and a cooling water pump that pumps the cooling water to the cooling water passage.

Although not clearly described in Japanese Patent Laid-Open No. 9-309497, generally, an outboard motor cools electrical components that generate heat, including components of a power supply system, and components that need to be cooled due to receiving heat from fuel, etc. Furthermore, the amount of heat generated by the outboard motor is particularly large in an engine. On the other hand, the amount of heat generated by components other than the engine is extremely small as compared with the amount of heat generated by the engine. Also in the outboard motor disclosed in Japanese Patent Laid-Open No. 9-309497, components other than the engine are conceivably cooled by at least one of the seawater (seawater passage) and the cooling water (cooling water passage).

However, when a component that requires a small amount of cooling water (a component that generates a smaller amount of heat than the engine) is incorporated in the cooling water passage via another route, the size of the cooling water pump is increased, and a loss of horsepower is increased.

SUMMARY OF THE INVENTION

Preferred embodiments of the present invention provide outboard motors and marine vessels that each reduce drive losses in cooling pumps.

An outboard motor according to a preferred embodiment of the present invention includes an engine, a first cooling water passage to cool a first cooling target including the engine and through which first cooling water including water from outside an outboard motor body passes, a first pump to pump the first cooling water from outside the outboard motor body to the first cooling water passage, a second cooling water passage to cool a second cooling target different from the first cooling target and through which second cooling water different from the first cooling water passes, and a second pump to pump the second cooling water to the second cooling water passage.

In an outboard motor according to a preferred embodiment of the present invention, with the structure described above, the first cooling target including the engine that generates a large amount of heat is cooled by the dedicated first cooling water passage and the first pump, and the second cooling target that is different from the first cooling target and generates a smaller amount of heat than the engine is cooled by the dedicated second cooling water passage and the second pump. Accordingly, the first pump or the second pump is selected depending on the amount of heat generated by each portion such that work is appropriately performed without waste. Consequently, a drive loss in the cooling pumps (the first pump and the second pump) of the outboard motor is significantly reduced or prevented. Furthermore, unlike the conventional structure in which the engine is cooled with two types of cooling water, the second cooling water passage is designed without passing through the engine, and thus the degree of freedom in layout at the time of design is improved. Accordingly, the outboard motor is easily designed in a layout that improves the water drainage property, in particular, the ease of draining seawater from the inside of the outboard motor to the outside when the engine is stopped.

In an outboard motor according to a preferred embodiment of the present invention, the first pump is preferably an engine-driven pump driven by a drive shaft that transmits a drive force of the engine to a propeller, and the second pump is preferably an electric pump. The amount of heat generated by the engine increases as the rotation speed increases. Therefore, with the structure described above, the flow rate of the first cooling water that flows through the first cooling water passage is increased by the engine-driven pump according to an increase in the amount of heat generated by the engine. Furthermore, when the second cooling target, the amount of heat generated by which does not depend on the rotation speed of the engine, is cooled by the electric pump, the flow rate of the second cooling water that flows through the second cooling water passage is adjusted independently of the first cooling water passage. In addition, an increase in the temperature of the second cooling target is significantly reduced or prevented by the electric pump even while the engine is stopped in which the first cooling water is not flowing through the first cooling water passage.

In an outboard motor according to a preferred embodiment of the present invention, the first pump is preferably a positive-displacement pump, and the second pump is preferably a non-positive displacement pump. Accordingly, a large amount of first cooling water is effectively pumped to the first cooling water passage by the positive-displacement pump having excellent self-priming ability. Furthermore, an appropriate amount of second cooling water is effectively pumped to the second cooling water passage by the non-positive displacement pump having excellent continuous liquid feeding ability. In addition, the first cooling water is pumped to the first cooling water passage regardless of the pump head (pumping head, lifting height of the first pump). Moreover, the non-positive displacement pump with less drive loss is used as the second pump such that an appropriate amount of second cooling water is pumped to the second cooling water passage, and the size of the first pump with more drive loss is reduced.

In an outboard motor according to a preferred embodiment of the present invention, the second cooling water preferably circulates in the second cooling water passage. Accordingly, foreign matter is prevented from entering the second cooling water passage from the outside. Furthermore, when the outboard motor is used in the sea, the time and effort required to perform a surface treatment (including coating) on the second cooling water passage in order to prevent corrosion due to seawater is reduced.

In such a case, an outboard motor according to a preferred embodiment of the present invention preferably further includes a first heat exchanger to cool the second cooling water with the first cooling water. Accordingly, the second cooling water is efficiently cooled with the first cooling water by the first heat exchanger.

In an outboard motor including the first heat exchanger, the first cooling water passage is preferably branched from upstream to downstream into two passages including a main passage that passes through the engine as the first cooling target and a secondary passage that passes through the first heat exchanger. Accordingly, the first cooling water passage is branched into two passages including the main passage and the secondary passage, such that the flow rate of the first cooling water that passes through the engine and the flow rate of the first cooling water that passes through the first heat exchanger are adjusted.

In an outboard motor in which the first cooling water passage is branched into the main passage and the secondary passage, the first heat exchanger is preferably located downstream of the first cooling target in the secondary passage. Accordingly, the second cooling water is cooled using the first cooling water that has finished cooling the components of the outboard motor in the secondary passage just prior to being discharged.

An outboard motor according to a preferred embodiment of the present invention preferably further includes an exhaust manifold as the first cooling target at, adjacent to, or in a vicinity of a branch point at which the first cooling water passage is branched into the main passage and the secondary passage. Accordingly, in the main passage, cooling is started from the exhaust manifold that generates a large amount of heat among the engine components, and thus the engine is effectively cooled.

In an outboard motor according to a preferred embodiment of the present invention, the second cooling target preferably includes an electrical component, and the second cooling water passage is preferably disposed along the electrical component to cool the electrical component with the second cooling water. Accordingly, the electrical component is cooled separately from the engine, and thus excessive cooling of the electrical component is significantly reduced or prevented.

In such a case, the second pump is preferably an electric pump, and the electrical component preferably includes a component of a power supply system that supplies electric power to each of the outboard motor and an electric motor of the electric pump. Accordingly, the component of the power supply system and the electric motor are cooled separately from the engine, and thus excessive cooling of the component of the power supply system and the electric motor is significantly reduced or prevented.

An outboard motor in which the electrical component is cooled with the second cooling water preferably further includes a second heat exchanger to cool engine oil with the first cooling water. Accordingly, the engine oil is cooled by the second heat exchanger, and thus the engine is cooled more effectively.

In an outboard motor in which the electrical component is cooled with the second cooling water, the first cooling target preferably includes a fuel tank, and the first cooling water passage is preferably disposed along the fuel tank to cool fuel in the fuel tank with the first cooling water. Accordingly, fuel vaporization due to an increase in the temperature of gas in the fuel tank resulting from an increase in the temperature of the fuel tank is significantly reduced or prevented. That is, a system to process vaporized fuel is downsized.

An outboard motor including the second heat exchanger preferably further includes a first heat exchanger to cool the second cooling water with the first cooling water, the first cooling water passage preferably cools one of the engine oil and fuel in a fuel tank with the first cooling water, and the second cooling water passage preferably cools the other of the engine oil and the fuel in the fuel tank with the second cooling water. Accordingly, when the first cooling water passage cools the fuel tank with the first cooling water, the first cooling water flows from the fuel tank to the first heat exchanger at a low rotation speed at which fuel cooling is required such that the temperatures of the electrical component and the fuel are reduced, and warming of the engine oil is promoted. The second cooling water flows from the first heat exchanger to the second heat exchanger at a medium or higher rotation speed such that the temperatures of the electrical component and the engine oil are reduced. When the first cooling water passage cools the engine oil with the first cooling water, the first cooling water flows from the second heat exchanger to the first heat exchanger at a low rotation speed such that the temperatures of the electrical component and the engine oil are reduced. The second cooling water flows from the first heat exchanger to the fuel tank at a medium or higher rotation speed such that the temperatures of the electrical component and the fuel are reduced.

In an outboard motor in which the second pump is the electric pump, and the electrical component includes the component of the power supply system and the electric motor, the component of the power supply system is preferably disposed adjacent to or in a vicinity of an engine control unit. Accordingly, wiring that connects the component of the power supply system to the engine control unit is shortened such that the configuration of the device is simplified.

A marine vessel according to a preferred embodiment of the present invention includes a hull and an outboard motor attached to the hull, and the outboard motor includes an engine, a first cooling water passage to cool a first cooling target including the engine and through which first cooling water including water from outside an outboard motor body passes, a first pump to pump the first cooling water from outside the outboard motor body to the first cooling water passage, a second cooling water passage to cool a second cooling target different from the first cooling target and through which second cooling water different from the first cooling water passes, and a second pump to pump the second cooling water to the second cooling water passage.

In a marine vessel according to a preferred embodiment of the present invention, with the structure described above, a drive loss in the cooling pumps (the first pump and the second pump) of the outboard motor is significantly reduced or prevented, similarly to the outboard motors according to preferred embodiments of the present invention described above.

In a marine vessel according to a preferred embodiment of the present invention, the first pump is preferably an engine-driven pump driven by a drive shaft that transmits a drive force of the engine to a propeller, and the second pump is preferably an electric pump. Accordingly, similarly to the outboard motors according to preferred embodiments of the present invention described above, the flow rate of the first cooling water that flows through the first cooling water passage is increased by the engine-driven pump according to an increase in the amount of heat generated by the engine. Furthermore, when the second cooling target, the amount of heat generated by which does not depend on the rotation speed of the engine, is cooled by the electric pump, the flow rate of the second cooling water that flows through the second cooling water passage is adjusted independently of the first cooling water passage.

In a marine vessel according to a preferred embodiment of the present invention, the first pump is preferably a positive-displacement pump, and the second pump is preferably a non-positive displacement pump. Accordingly, similarly to the outboard motors according to preferred embodiments of the present invention described above, a large amount of first cooling water is effectively pumped to the first cooling water passage by the positive-displacement pump, and an appropriate amount of second cooling water is effectively pumped to the second cooling water passage by the non-positive displacement pump.

In a marine vessel according to a preferred embodiment of the present invention, the second cooling water preferably circulates in the second cooling water passage. Accordingly, similarly to the outboard motors according to preferred embodiments of the present invention described above, foreign matter is prevented from entering the second cooling water passage from the outside. Furthermore, when the marine vessel is used in the sea, the time and effort required to perform a surface treatment (including coating) on the second cooling water passage in order to prevent corrosion due to seawater is reduced.

In such a case, the outboard motor preferably further includes a heat exchanger to cool the second cooling water with the first cooling water. Accordingly, similarly to the outboard motors according to preferred embodiments of the present invention described above, the second cooling water is efficiently cooled with the first cooling water by the heat exchanger.

In a marine vessel according to a preferred embodiment of the present invention, the second cooling target preferably includes an electrical component, and the second cooling water passage is preferably disposed along the electrical component to cool the electrical component with the second cooling water. Accordingly, similarly to the outboard motors according to preferred embodiments of the present invention described above, the electrical component is cooled separately from the engine, and thus excessive cooling of the electrical component is significantly reduced or prevented.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

First Preferred Embodiment

The structure of a marine vessel 101 including an outboard motor 100 according to a first preferred embodiment of the present invention is now described with reference to FIGS. 1 to 4.

In the figures, arrow FWD represents the forward movement direction of the marine vessel 101, and arrow BWD represents the reverse movement direction of the marine vessel 101. In addition, in the figures, arrow R represents the starboard direction of the marine vessel 101, and arrow L represents the portside direction of the marine vessel 101. Furthermore, in the figures, a Z (Z1, Z2) direction represents an upward-downward direction.

Figure 1:
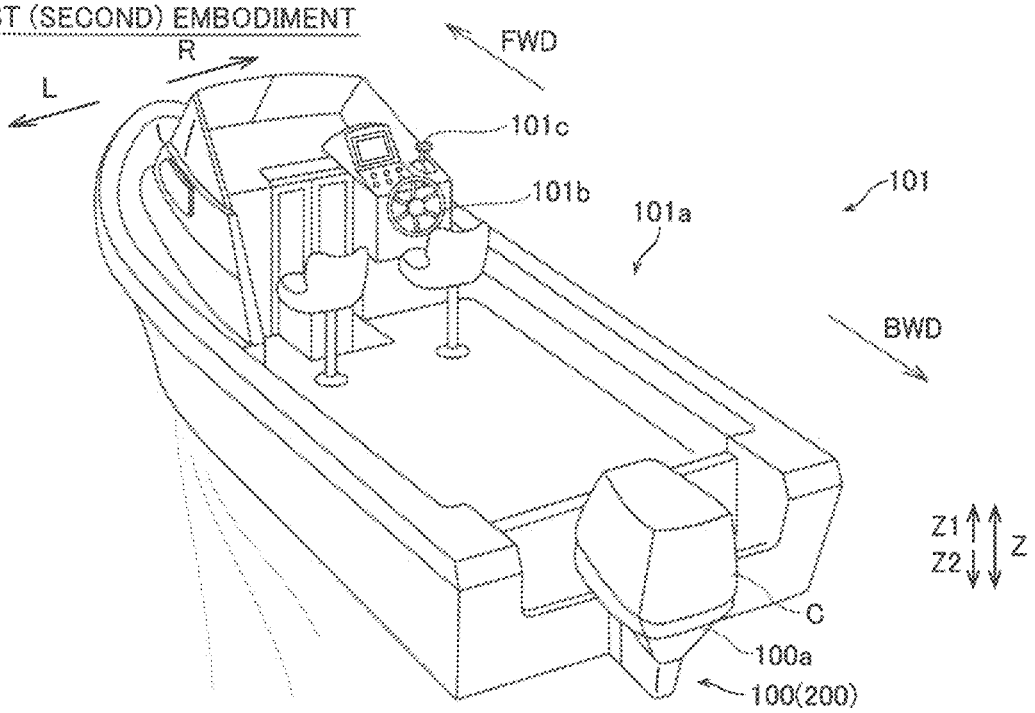
FIG. 1 is a perspective view schematically showing a marine vessel including an outboard motor according to first and second preferred embodiments of the present invention.

As shown in FIG. 1, the marine vessel 101 includes the outboard motor 100, a hull 101*a*, a steering wheel 101*b*, and a remote control 101*c*.

The steering wheel 101*b* is operated to steer the hull 101*a* (turn the outboard motor 100). Specifically, the steering wheel 101*b* is connected to a steering (not shown) of the outboard motor 100. The outboard motor 100 is rotated in a horizontal direction by the steering based on the operation of the steering wheel 101*b*.

The remote control 101*c* is operated to switch the shift state (the forward movement state, reverse movement state, or neutral state) of the outboard motor 100 and change the output (throttle opening degree) of the outboard motor 100. Specifically, the remote control 101*c* is connected to an engine 1 (see FIG. 2) and a shift actuator (not shown) of the outboard motor 100. The output and shift state of the engine 1 of the outboard motor 100 are controlled based on the operation of the remote control 101*c*.

The outboard motor 100 includes a bracket Br, and is attached to a rear end of the hull 101*a* via the bracket Br.

Figure 2:
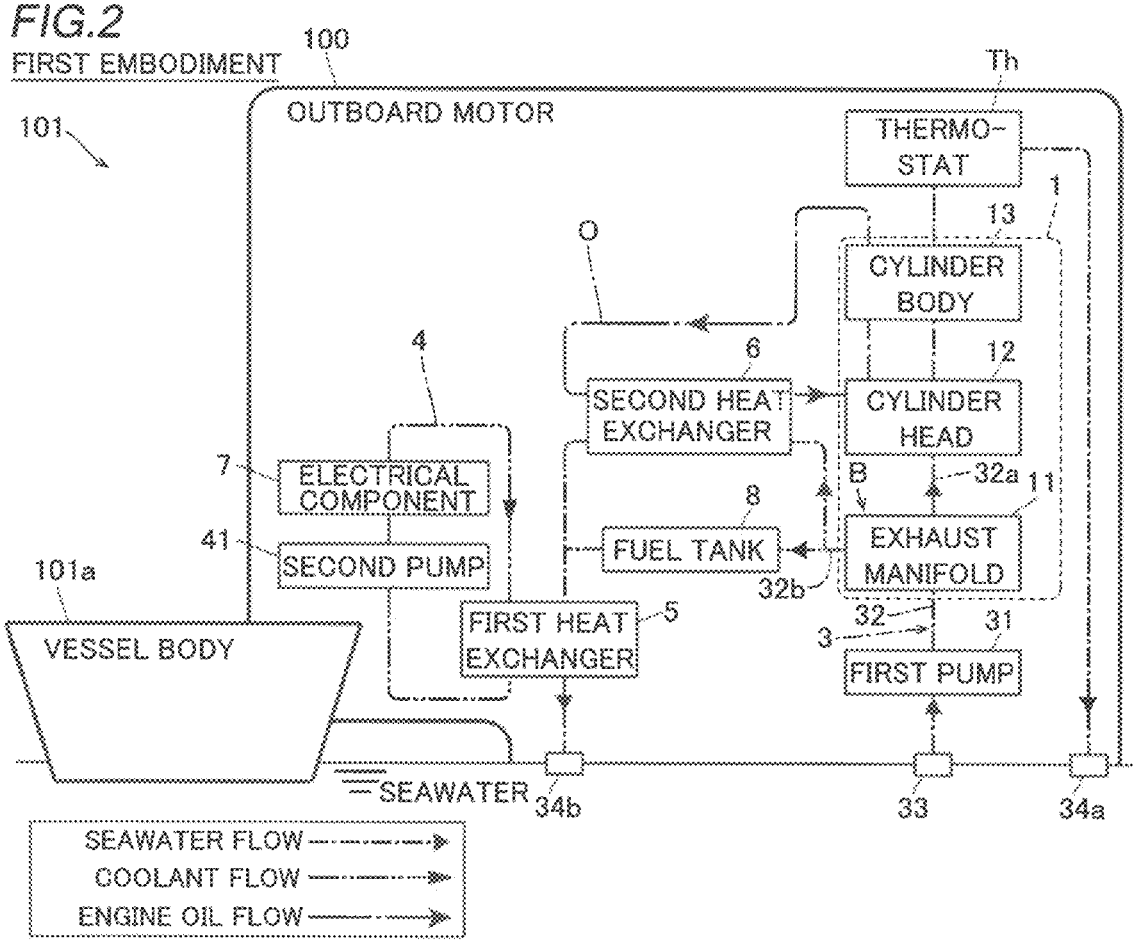
FIG. 2 is a block diagram showing the outboard motor according to the first preferred embodiment of the present invention.

As shown in FIG. 2, the outboard motor 100 includes the engine 1, a drive shaft 1*a* (see FIG. 3), an engine control unit (ECU) 2 (see FIG. 3), a seawater passage 3, and a first pump 31 (water pump), a coolant passage 4, a second pump 41, a first heat exchanger 5, a second heat exchanger 6, an electrical component 7, and a fuel tank 8. The seawater passage 3 is an example of a "first cooling water passage". The coolant passage 4 is an example of a "second cooling water passage".

Figure 3:
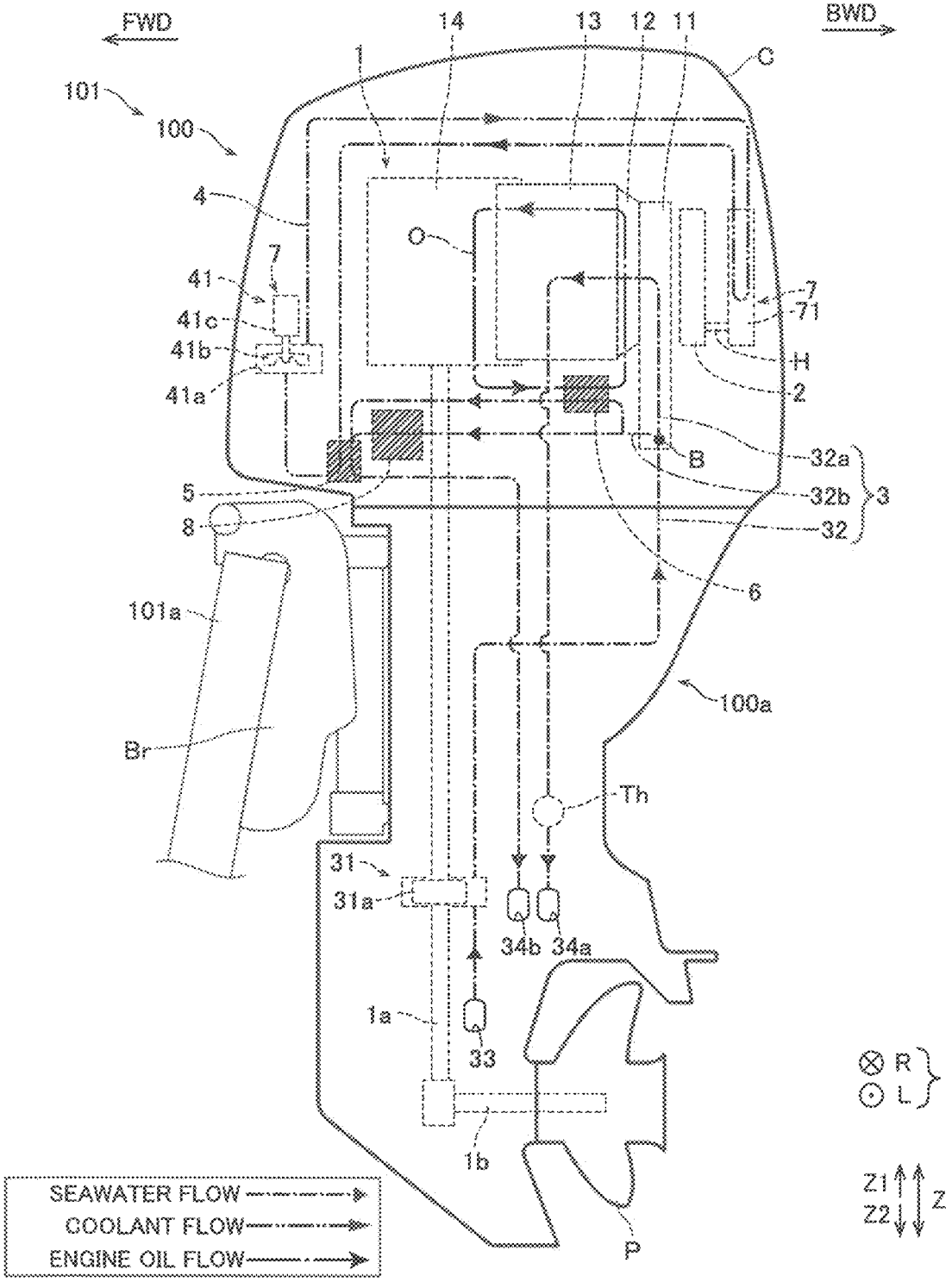
FIG. 3 is a side view showing the outboard motor according to the first preferred embodiment of the present invention.
Figure 4:
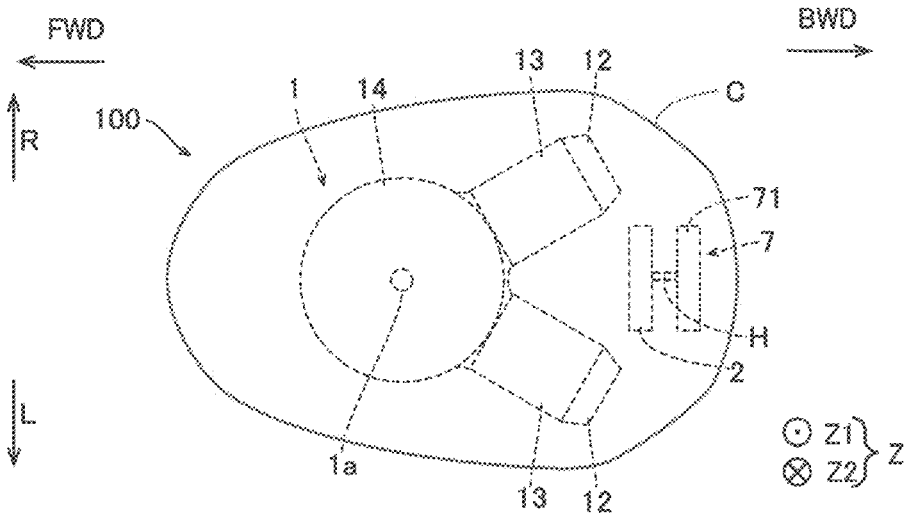
FIG. 4 is a plan view showing the outboard motor according to the first preferred embodiment of the present invention.

As shown in FIG. 3, the engine 1 is housed inside a cowling C. The engine 1 includes an exhaust manifold 11, a cylinder head 12, and a cylinder body 13.

The exhaust manifold 11 is disposed behind the cylinder head 12 and the cylinder body 13. The cylinder head 12 is disposed adjacent to or in the vicinity of the exhaust manifold 11 relative to the cylinder body 13.

As an example, in the engine 1, a plurality of pistons (not shown) disposed behind the drive shaft 1*a* (crankcase 14) reciprocate in the horizontal or substantially horizontal direction, and the engine 1 is a multi-cylinder V-type or V-shaped engine (see FIG. 4), for example, in which cylinders are disposed in a V-shape in a plan view.

The engine 1 is a component that generates a large amount of heat particularly in the outboard motor 100. Furthermore, in the engine 1, the amount of heat generated is particularly large in the cylinders (the cylinder head 12 and the cylinder body 13) in which fuel is burned and the exhaust manifold 11 through which exhaust gas passes. The engine 1 is a component in which the amount of heat generated increases as the rotation speed increases.

Therefore, the outboard motor 100 increases or decreases the flow rate of seawater that passes through the seawater passage 3 to increase or decrease the cooling capacity of the outboard motor 100 according to an increase or decrease in the rotation speed which affects the amount of heat generated by the engine 1, and directly cools the engine 1 with the seawater. The details are described below. The seawater is an example of "first cooling water".

The drive shaft 1*a* transmits the rotational drive force of the engine 1 to a propeller P via a propeller shaft 1*b*. The drive shaft 1*a* extends in the upward-downward direction (Z direction), and the upper end of the drive shaft 1*a* is connected to a crankshaft (not shown) of the engine 1. The lower end of the drive shaft 1*a* is located below the water surface. The first pump 31, for example a rotor 31*a* of the first pump 31, is directly fixed to the drive shaft 1*a* at a predetermined position below the cowling C in the upward-downward direction.

The engine control unit 2 is disposed behind the engine 1 inside the cowling C. The engine control unit 2 is disposed adjacent to or in the vicinity of the engine 1. The engine control unit 2 is disposed at the center or substantially at the center of the engine 1 in a width direction (see FIG. 4). The engine control unit 2 is disposed at a position that overlaps the engine 1 in a height direction.

The engine control unit 2 is connected to a component 71 of a power supply system, which includes the electrical component 7, by wiring H. The component 71 of the power supply system includes a rectifier regulator (REC/REG) that converts electric power generated based on driving of the engine 1 into a direct current having a predetermined voltage and outputs the direct current to a battery (not shown). The component 71 of the power supply system is disposed in the vicinity of the engine 1 behind the engine control unit 2.

The seawater passage 3 is a passage for cooling water through which seawater pumped from the outside of an outboard motor body 100*a* passes. The seawater passage 3 cools a first cooling target including the engine 1. A portion of the seawater passage 3 that contacts the seawater is subjected to surface treatment (including coating) that provides corrosion resistance in order to prevent corrosion by seawater.

The first cooling target includes the engine 1, engine oil, and the fuel (fuel tank 8), and is cooled by the seawater passage 3 (seawater).

The seawater passage 3 is branched from upstream to downstream into two passages including a main passage 32*a* that passes through the engine 1 and a secondary passage 32*b* that passes through the first heat exchanger 5. That is, the seawater passage 3 includes one upstream passage 32 through which seawater pumped from the outside of the outboard motor body 100*a* first flows, and downstream passages (the main passage 32*a* and the secondary passage 32*b*) disposed downstream thereof.

A water inlet 33 through which seawater is taken in from the outside is provided at the upstream end of the upstream passage 32. Water outlets 34*a* and 34*b* through which seawater is discharged to the outside are provided at the downstream ends of the main passage 32*a* and the secondary passage 32*b*, respectively.

The first pump 31 to pump seawater is located in the middle of the upstream passage 32. The upstream passage 32 is located along an exhaust passage (not shown) through which exhaust gas is discharged to the outside.

The exhaust manifold 11 as the first cooling target is located at a branch point B at which the upstream passage 32 is branched into the main passage 32*a* and the secondary passage 32*b*.

The main passage 32*a* passes through a cylinder unit downstream of the exhaust manifold 11. Specifically, the main passage 32*a* passes through the inside of the cylinder head 12 including a cooling jacket downstream of the exhaust manifold 11. Furthermore, the main passage 32*a* passes through the inside of the cylinder body 13 including a cooling jacket downstream of the cylinder head 12.

A thermostat Th is provided downstream of the cylinder body 13 in the main passage 32*a*. When the rotation speed of the engine 1 increases, the opening of the thermostat Th gradually increases as the water temperature increases, such that the flow rate of seawater that passes through the main passage 32*a* gradually increases. Therefore, when the flow rate of the seawater that passes through the main passage 32*a* gradually increases, the flow rate of seawater that passes through the secondary passage 32*b* gradually decreases.

On the other hand, when the rotation speed of the engine 1 decreases, the opening of the thermostat Th gradually decreases as the water temperature decreases, such that the flow rate of the seawater that passes through the main passage 32*a* gradually decreases. Therefore, when the flow rate of the seawater that passes through the main passage 32*a* gradually decreases, the flow rate of the seawater that passes through the secondary passage 32*b* gradually increases.

Thus, the outboard motor 100 increases or decreases the flow rate of the seawater that passes through the seawater passage 3 to increase or decrease the cooling capacity of the outboard motor 100 according to an increase or decrease in the rotation speed which affects the amount of heat generated by the engine 1, and directly cools the engine 1 with the seawater.

The secondary passage 32*b* passes through the fuel tank 8 downstream of the exhaust manifold 11. Specifically, the first cooling target includes the fuel tank 8, and the secondary passage 32*b* (seawater passage 3) is disposed along the fuel tank 8 to cool the fuel in the fuel tank 8 with the seawater. The fuel tank 8 is disposed in front of the drive shaft 1*a*, and is housed inside the cowling C. The fuel tank 8 is disposed in a lower portion of the cowling C.

The secondary passage 32*b* passes through the second heat exchanger 6 downstream of the exhaust manifold 11. Specifically, the secondary passage 32*b* (seawater passage 3) is disposed along the second heat exchanger 6 to cool the engine oil with the seawater. The engine oil is delivered by an oil pump (not shown), and is circulated in the engine 1 along an engine oil passage O.

The fuel tank 8 and the second heat exchanger 6 are disposed in parallel in the secondary passage 32*b*. That is, the seawater flow is split to cool the fuel tank 8 and the second heat exchanger 6 separately with the secondary passage 32*b* (seawater passage 3) such that an excessive amount of seawater does not flow through the fuel tank 8 and the second heat exchanger 6.

The secondary passage 32*b* passes through the first heat exchanger 5 downstream of the fuel tank 8 and the second heat exchanger 6. That is, the first heat exchanger 5 is located downstream of the fuel tank 8 to cool the fuel, which is the first cooling target, and the second heat exchanger 6 to cool the engine oil in the secondary passage 32*b*.

The first heat exchanger 5 exchanges heat between the seawater that passes through the seawater passage 3 and coolant that passes through the coolant passage 4. That is, the first heat exchanger 5 cools the coolant with the seawater immediately before being discharged via the water outlet 34*a*. The coolant is an example of "second cooling water".

The first pump 31 (water pump) is housed inside the cowling C. The first pump 31 pumps seawater from the outside of the outboard motor body 100*a* to the seawater passage 3. That is, the first pump 31 provides kinetic energy to the seawater in order to pump the seawater to the seawater passage 3.

The first pump 31 is an engine-driven pump driven by the drive shaft 1*a* that transmits the drive force of the engine 1 to the propeller P. That is, as described above, the rotor 31*a* is directly fixed to the drive shaft 1*a* such that the first pump 31 obtains a drive force from the drive shaft 1*a*. Therefore, the first pump 31 stops while the engine 1 is stopped.

The first pump 31 is a positive-displacement pump. The positive-displacement pump refers to a pump of a type in which a drive such as the rotor 31*a* generates a negative pressure on the suction side of the pump such that a fluid is pumped, and the drive generates a positive pressure on the discharge side of the pump such that the fluid is discharged, and has excellent self-priming ability.

The coolant passage 4 is a passage for cooling water through which a coolant, which is cooling water different from seawater, passes. The coolant passage 4 is a closed loop such that the coolant circulates therein. Unlike the seawater passage 3 through which seawater flows, the coolant passage 4 is not subjected to surface treatment (including coating) to prevent corrosion.

The coolant passage 4 cools a second cooling target different from the first cooling target. Specifically, the second cooling target includes the electrical component 7, and the coolant passage 4 is disposed along the electrical component 7 to cool the electrical component 7 with the coolant. The flow rate of the coolant that passes through the coolant passage 4 per unit time is generally smaller than the flow rate of the seawater that passes through the seawater passage 3 per unit time.

The second cooling target includes the electrical component 7, and is cooled by the coolant passage 4 (coolant). The electrical component 7 includes at least an electric motor 41*c* described below and the component 71 of the power supply system.

The second pump 41 pumps the coolant to the coolant passage 4. That is, the second pump 41 provides kinetic energy to the coolant in order to circulate the coolant in the coolant passage 4.

The second pump 41 is an electric pump including an impeller 41*b* disposed in a pump chamber 41*a* and the electric motor 41*c* that rotationally drives the impeller 41*b*. Therefore, unlike the first pump 31, the second pump 41 is driven even while the engine 1 is stopped in which the seawater is not flowing through the seawater passage 3. Thus, the outboard motor 100 cools the heat generated by the engine 1 with the coolant even after the engine 1 is stopped.

The second pump 41 is a non-positive displacement pump. The non-positive displacement pump refers to a pump of a type in which the kinetic energy of a drive such as the impeller 41*b* is converted into the kinetic energy of a fluid such that the fluid is pumped, and has excellent continuous liquid feeding ability.

According to the first preferred embodiment of the present invention, the following advantageous effects are achieved.

According to the first preferred embodiment of the present invention, the first cooling target including the engine 1 that generates a large amount of heat is cooled by the dedicated seawater passage 3 and the first pump 31, and the second cooling target that is different from the first cooling target and generates a smaller amount of heat than the engine 1 is cooled by the dedicated coolant passage 4 and the second pump 41. Accordingly, the first pump 31 or the second pump 41 is selected depending on the amount of heat generated by each portion such that work is appropriately performed without waste. Consequently, a drive loss in the cooling pumps (the first pump 31 and the second pump 41) of the outboard motor 100 is significantly reduced or prevented. Furthermore, unlike the conventional structure in which the engine is cooled with two types of cooling water, the coolant passage 4 is designed without passing through the engine 1, and thus the degree of freedom in layout at the time of design is improved. Accordingly, the outboard motor 100 is easily designed in a layout that improves the water drainage property, in particular, the ease of draining seawater from the inside of the outboard motor 100 to the outside when the engine 1 is stopped.

According to the first preferred embodiment of the present invention, the first pump 31 is an engine-driven pump driven by the drive shaft 1*a* that transmits the drive force of the engine 1 to the propeller P, and the second pump 41 is an electric pump. The amount of heat generated by the engine 1 increases as the rotation speed increases. Therefore, with the structure described above, the flow rate of the seawater that flows through the seawater passage 3 is increased by the engine-driven pump (first pump 31) according to an increase in the amount of heat generated by the engine 1. Furthermore, when the second cooling target, the amount of heat generated by which does not depend on the rotation speed of the engine 1, is cooled by the electric pump (second pump 41), the flow rate of the coolant that flows through the coolant passage 4 is adjusted independently of the seawater passage 3. In addition, an increase in the temperature of the second cooling target is significantly reduced or prevented by the electric pump even while the engine 1 is stopped in which the seawater is not flowing through the seawater passage 3.

According to the first preferred embodiment of the present invention, the first pump 31 is a positive-displacement pump, and the second pump 41 is a non-positive displacement pump. Accordingly, a large amount of seawater is effectively pumped to the seawater passage 3 by the positive-displacement pump (first pump 31) having excellent self-priming ability. Furthermore, an appropriate amount of coolant is effectively pumped to the coolant passage 4 by the non-positive displacement pump (second pump 41) having excellent continuous liquid feeding ability. In addition, seawater is pumped to the seawater passage 3 regardless of the pump head (pumping head, lifting height of the first pump). Moreover, the non-positive displacement pump with less drive loss is used as the second pump 41 such that an appropriate amount of coolant is pumped to the coolant passage 4, and the size of the first pump 31 with more drive loss is reduced.

According to the first preferred embodiment of the present invention, the coolant circulates in the coolant passage 4. Accordingly, foreign matter is prevented from entering the coolant passage 4 from the outside. Furthermore, when the outboard motor 100 is used in the sea, the time and effort required to perform a surface treatment (including coating) on the coolant passage 4 in order to prevent corrosion due to seawater is reduced.

According to the first preferred embodiment of the present invention, the outboard motor 100 includes the first heat exchanger 5 to cool the coolant with seawater. Accordingly, the coolant is efficiently cooled with the seawater by the first heat exchanger 5.

According to the first preferred embodiment of the present invention, the seawater passage 3 is branched from upstream to downstream into two passages including the main passage 32*a* that passes through the engine 1 as the first cooling target and the secondary passage 32*b* that passes through the first heat exchanger 5. Accordingly, the seawater passage 3 is branched into two passages including the main passage 32*a* and the secondary passage 32*b*, such that the flow rate of the seawater that passes through the engine 1 and the flow rate of the seawater that passes through the first heat exchanger 5 are adjusted.

According to the first preferred embodiment of the present invention, the first heat exchanger 5 is located downstream of the first cooling target in the secondary passage 32*b*. Accordingly, the coolant is cooled using the seawater that has finished cooling the components of the outboard motor 100 in the secondary passage 32*b* just prior to being discharged.

According to the first preferred embodiment of the present invention, the exhaust manifold 11 as the first cooling target is located at the branch point B at which the seawater passage 3 is branched into the main passage 32*a* and the secondary passage 32*b*. Accordingly, in the main passage 32*a*, cooling is started from the exhaust manifold 11 that generates a large amount of heat among the engine components, and thus the engine 1 is effectively cooled.

According to the first preferred embodiment of the present invention, the second cooling target includes the electrical component 7, and the coolant passage 4 is disposed along the electrical component 7 to cool the electrical component 7 with the coolant. Accordingly, the electrical component 7 is cooled separately from the engine 1, and thus excessive cooling of the electrical component 7 is significantly reduced or prevented.

According to the first preferred embodiment of the present invention, the second pump 41 is an electric pump, and the electrical component 7 includes the component 71 of the power supply system that supplies electric power to each of the outboard motor 100 and the electric motor 41*c* of the electric pump. Accordingly, the component 71 of the power supply system and the electric motor 41*c* are cooled separately from the engine 1, and thus excessive cooling of the component 71 of the power supply system and the electric motor 41*c* is significantly reduced or prevented.

According to the first preferred embodiment of the present invention, the outboard motor 100 further includes the second heat exchanger 6 to cool the engine oil with the seawater. Accordingly, the engine oil is cooled by the second heat exchanger 6, and thus the engine 1 is cooled more effectively.

According to the first preferred embodiment of the present invention, the first cooling target includes the fuel tank 8, and the seawater passage 3 is disposed along the fuel tank 8 to cool the fuel in the fuel tank 8 with the seawater. Accordingly, fuel vaporization due to an increase in the temperature of gas in the fuel tank 8 resulting from an increase in the temperature of the fuel tank 8 is significantly reduced or prevented. That is, a system to process vaporized fuel is downsized.

According to the first preferred embodiment of the present invention, the component 71 of the power supply system is disposed adjacent to or in the vicinity of the engine control unit 2. Accordingly, the wiring H that connects the component 71 of the power supply system to the engine control unit 2 is shortened such that the configuration of the device is simplified.

Second Preferred Embodiment

A second preferred embodiment of the present invention is now described with reference to FIG. 5. In the second preferred embodiment, a coolant passage 204 cools another component in addition to an electrical component 7, unlike the first preferred embodiment in which the coolant passage 4 cools only the electrical component 7. In the second preferred embodiment, the same or similar structures as those of the first preferred embodiment are denoted by the same reference numerals, and description thereof is omitted. The coolant passage 204 is an example of a "second cooling passage".

Figure 5:
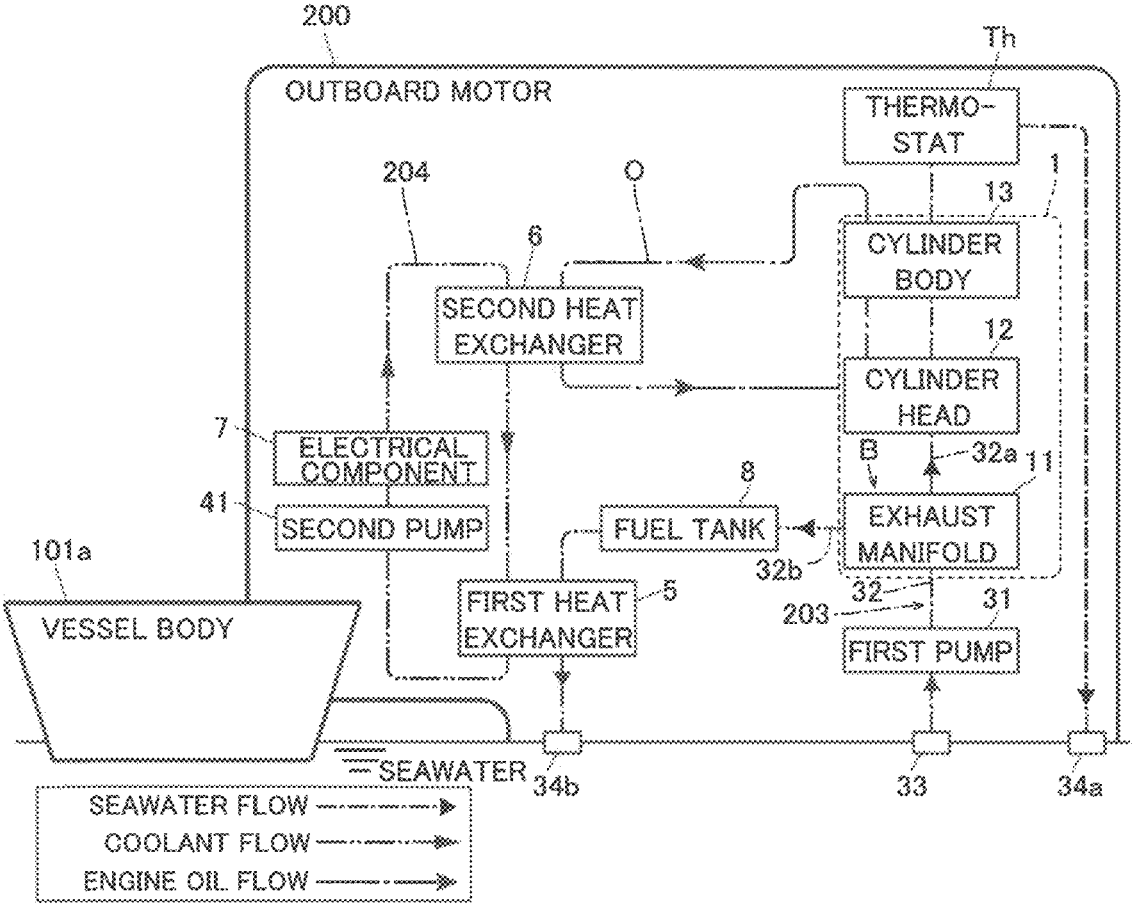
FIG. 5 is a block diagram showing the outboard motor according to the second preferred embodiment of the present invention.

As shown in FIG. 5, an outboard motor 200 according to the second preferred embodiment includes a seawater passage 203 and the coolant passage 204. The seawater passage 203 is an example of a "first cooling passage".

Unlike the first preferred embodiment, a second heat exchanger 6 is not provided in the seawater passage 203. The remaining configuration of the seawater passage 203 is the same as that of the first embodiment. The remaining structures in the seawater passage 203 are similar to those of the first preferred embodiment.

The second heat exchanger 6 is provided in the coolant passage 204. That is, the seawater passage 203 according to the second preferred embodiment has a smaller cooling capacity than that of the seawater passage 3 according to the first preferred embodiment. In short, in the outboard motor 200 according to the second preferred embodiment, the work of a first pump 31 is reduced such that the flow rate of seawater supplied to the seawater passage 203 is smaller than that of the outboard motor 100 according to the first preferred embodiment. Thus, in the outboard motor 200, a drive loss (work loss) is reduced in the first pump 31, which is a positive-displacement pump in which a work loss tends to be relatively increased.

The remaining structures of the second preferred embodiment are similar to those of the first preferred embodiment.

According to the second preferred embodiment of the present invention, the following advantageous effects are achieved.

According to the second preferred embodiment of the present invention, with the structure described above, a drive loss in cooling pumps (the first pump 31 and a second pump 41) of the outboard motor 200 is significantly reduced or prevented similarly to the first preferred embodiment.

According to the second preferred embodiment of the present invention, the seawater passage 3 cools the fuel in the fuel tank 8 with seawater, and the coolant passage 4 cools engine oil with coolant. Accordingly, the seawater flows from the fuel tank 8 to the first heat exchanger 5 at a low rotation speed at which fuel cooling is required such that the temperatures of the electrical component and the fuel are reduced, and warming of the engine oil is promoted. The coolant flows from the first heat exchanger 5 to the second heat exchanger 6 at a medium or higher rotation speed such that the temperatures of the electrical component and the engine oil are reduced.

The remaining advantageous effects of the second preferred embodiment are similar to those of the first preferred embodiment.

The preferred embodiments of the present invention described above are illustrative in all points and not restrictive. The extent of the present invention is not defined by the above description of the preferred embodiments but by the scope of the claims, and all modifications within the meaning and range equivalent to the scope of the claims are further included.

For example, while seawater is preferably used as the first cooling water in each of the first and second preferred embodiments described above, the present invention is not restricted to this. In the present invention, lake water or pond water may alternatively be used as the first cooling water, for example.

While the exhaust manifold is preferably located at the branch point of the seawater passage (first cooling water passage) in each of the first and second preferred embodiments described above, the present invention is not restricted to this. In the present invention, the exhaust manifold may not be located at the branch point. The exhaust manifold is preferably located adjacent to or in the vicinity of the branch point.

While the first pump is preferably an engine-driven pump in each of the first and second preferred embodiments described above, the present invention is not restricted to this. In the present invention, the first pump may alternatively be an electric pump.

While the first pump is preferably a positive-displacement pump in each of the first and second preferred embodiments described above, the present invention is not restricted to this. In the present invention, the first pump may alternatively be a non-positive displacement pump.

While the second pump is preferably an electric pump in each of the first and second preferred embodiments described above, the present invention is not restricted to this. In the present invention, the second pump may alternatively be an engine-driven pump.

While the second pump is preferably a non-positive displacement pump in each of the first and second preferred embodiments described above, the present invention is not restricted to this. In the present invention, the second pump may alternatively be a positive displacement pump.

While the first pump and the second pump preferably use different drive systems in each of the first and second preferred embodiments described above, the present invention is not restricted to this. In the present invention, the first pump and the second pump may alternatively use the same drive system.

While the electrical component preferably includes the component of the power supply system and the electric motor in each of the first and second preferred embodiments described above, in the present invention, the electrical component may not include the component of the power supply system and the electric motor, and the electrical component may alternatively include another component such as a generator.

While separate water outlets are preferably provided for the main passage and the secondary passage to discharge the seawater separately in each of the first and second preferred embodiments described above, the present invention is not restricted to this. In the present invention, the main passage and the second passage may alternatively be combined to discharge the seawater via one water outlet. Furthermore, the seawater may alternatively be discharged to the exhaust passage, and may alternatively be discharged to the outside of the outboard motor together with exhaust gas.

While the components of the engine are preferably cooled with the first cooling water in the order of the exhaust manifold, the cylinder head, and the cylinder body in each of the first and second preferred embodiments described above, the present invention is not restricted to this. In the present invention, the components of the engine may alternatively be cooled with the first cooling water in the order of the cylinder body, the cylinder head, and the exhaust manifold, for example.

While the first heat exchanger is preferably located downstream of the first cooling target in the secondary passage in each of the first and second preferred embodiments described above, the present invention is not restricted to this. In the present invention, the first heat exchanger may alternatively be located upstream of the first cooling target in the secondary passage.

While the component of the power supply system is preferably disposed adjacent to or in the vicinity of the engine control unit in each of the first and second preferred embodiments described above, the present invention is not restricted to this. In the present invention, the component of the power supply system may not be disposed adjacent to or in the vicinity of the engine control unit but may alternatively be spaced apart from the engine control unit.

While the entire coolant passage (second cooling water passage) is preferably disposed inside the cowling in each of the first and second preferred embodiments described above, the present invention is not restricted to this. In the present invention, at least a portion of the coolant passage (second cooling water passage) may alternatively be disposed outside the cowling.

While the electrical component is preferably disposed along the coolant passage (second cooling water passage) in each of the first and second preferred embodiments described above, the present invention is not restricted to this. In the present invention, the electrical component may alternatively be disposed along the seawater passage (first cooling water passage).

While the second heat exchanger to cool the engine oil is preferably disposed along the coolant passage (second cooling water passage) in the second preferred embodiment described above, the present invention is not restricted to this. In the present invention, instead of the second heat exchanger, the fuel tank may alternatively be disposed along the coolant passage (second cooling water passage). In such a case, the second heat exchanger is disposed along the seawater passage (first cooling water passage).

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an engine;

a first cooling water passage to cool a first cooling target including the engine and through which first cooling water including water from outside an outboard motor body passes;

a first pump to pump the first cooling water from outside the outboard motor body to the first cooling water passage;

a second cooling water passage to cool a second cooling target different from the first cooling target and through which second cooling water different from the first cooling water passes without passing through the engine; and a second pump to pump the second cooling water to the second cooling water passage.

2. The outboard motor according to claim 1, wherein the first pump is an engine-driven pump driven by a drive shaft that transmits a drive force of the engine to a propeller; and the second pump is an electric pump.

3. The outboard motor according to claim 1, wherein the first pump is a positive-displacement pump; and the second pump is a non-positive displacement pump.

4. The outboard motor according to claim 1, wherein the second cooling water circulates in the second cooling water passage.

5. The outboard motor according to claim 4, further comprising a first heat exchanger to cool the second cooling water with the first cooling water.

6. The outboard motor according to claim 5, wherein the first cooling water passage is branched from upstream to downstream into two passages including a main passage that passes through the engine as the first cooling target and a secondary passage that passes through the first heat exchanger.

7. The outboard motor according to claim 6, wherein the first cooling target includes the engine and a predetermined cooling target in the secondary passage that is different from the engine; and the first heat exchanger is located downstream of the predetermined cooling target of the first cooling target in the secondary passage.

8. The outboard motor according to claim 6, wherein the first cooling target includes the engine and a predetermined cooling target that is different from the engine; and the first cooling target includes an exhaust manifold as the predetermined cooling target at, adjacent to, or in a vicinity of a branch point at which the first cooling water passage is branched into the main passage and the secondary passage.

9. The outboard motor according to claim 1, wherein the second cooling target includes an electrical component, and the second cooling water passage is disposed along the electrical component to cool the electrical component with the second cooling water.

10. The outboard motor according to claim 9, wherein the second pump is an electric pump; and the electrical component includes a component of a power supply system that supplies electric power to each of the outboard motor and an electric motor of the electric pump.

11. The outboard motor according to claim 9, further comprising a second heat exchanger to cool engine oil with the first cooling water.

12. The outboard motor according to claim 9, wherein the first cooling target includes the engine and a predetermined cooling target that is different from the engine; and the first cooling target includes a fuel tank as the predetermined cooling target, and the first cooling water passage is disposed along the fuel tank to cool fuel in the fuel tank with the first cooling water.

13. The outboard motor according to claim 11, further comprising a first heat exchanger to cool the second cooling water with the first cooling water; wherein the first cooling water passage cools one of the engine oil and fuel in a fuel tank with the first cooling water; and the second cooling water passage cools the other of the engine oil and the fuel in the fuel tank with the second cooling water.

14. The outboard motor according to claim 10, wherein the component of the power supply system is disposed adjacent to or in a vicinity of an engine control unit.

15. A marine vessel comprising:

a hull; and an outboard motor attached to the hull; wherein the outboard motor includes:

an engine;

a first cooling water passage to cool a first cooling target including the engine and through which first cooling water including water from outside an outboard motor body passes;

a first pump to pump the first cooling water from outside the outboard motor body to the first cooling water passage;

a second cooling water passage to cool a second cooling target different from the first cooling target and through which second cooling water different from the first cooling water passes without passing through the engine; and a second pump to pump the second cooling water to the second cooling water passage.

16. The marine vessel according to claim 15, wherein the first pump is an engine-driven pump driven by a drive shaft that transmits a drive force of the engine to a propeller; and the second pump is an electric pump.

17. The marine vessel according to claim 15, wherein the first pump is a positive-displacement pump; and the second pump is a non-positive displacement pump.

18. The marine vessel according to claim 15, wherein the second cooling water circulates in the second cooling water passage.

19. The marine vessel according to claim 18, wherein the outboard motor further includes a heat exchanger to cool the second cooling water with the first cooling water.

20. The marine vessel according to claim 15, wherein the second cooling target includes an electrical component, and the second cooling water passage is disposed along the electrical component to cool the electrical component with the second cooling water.

* * * * *